United States Patent [19]

Latza et al.

[11] Patent Number: 4,711,193

[45] Date of Patent: Dec. 8, 1987

[54] SELF-CONTAINED VENTILATION SYSTEM UNITS FOR SUPPLYING SPACES BETWEEN BULKHEADS WITH INDIVIDUALLY CIRCULATED VENTILATION AIR

[75] Inventors: Joachim Latza, Hamburg-Norderstedt; Günther Möck, Hamburg, both of Fed. Rep. of Germany

[73] Assignee: Blohm & Voss AG, Hamburg, Fed. Rep. of Germany

[21] Appl. No.: 868,940

[22] Filed: May 30, 1986

[30] Foreign Application Priority Data

May 30, 1985 [DE] Fed. Rep. of Germany ..... 3519394

[51] Int. Cl.[4] ..... B63J 2/14

[52] U.S. Cl. ..... 114/211; 114/177; 62/240; 98/53

[58] Field of Search ..... 114/177, 178, 211, 72; 62/238.1, 239, 240, 409; 98/33.1, 53, 29, 31.5, 32, 34.5, 34.6; 165/108, 47

[56] References Cited

U.S. PATENT DOCUMENTS

| | | | |
|---|---|---|---|
| 2,160,831 | 6/1939 | Colby | 114/211 |
| 2,356,391 | 8/1944 | Fluor | 114/211 |
| 2,599,925 | 6/1952 | Lamb | 114/211 |
| 3,120,796 | 2/1964 | Clark | 114/211 |
| 3,489,119 | 1/1970 | Wemmerus | 114/211 |
| 3,557,740 | 1/1971 | Pratt | 114/211 |
| 4,428,318 | 1/1984 | Huchzermeier | 114/211 |

FOREIGN PATENT DOCUMENTS

| | | | |
|---|---|---|---|
| 2017950 | 10/1971 | Fed. Rep. of Germany | 114/211 |
| 922811 | 4/1963 | United Kingdom | 114/211 |
| 972530 | 10/1964 | United Kingdom | 114/211 |

OTHER PUBLICATIONS

Oesten, J., "Schiffssicherheit und Lüftungsanlagen", 1970, pp. 849–850.

*Primary Examiner*—Joseph F. Peters, Jr.
*Assistant Examiner*—Clifford T. Bartz
*Attorney, Agent, or Firm*—Nils H. Ljungman

[57] ABSTRACT

A ship, with several decks and several areas located one behind the other in the longitudinal direction of the ship, which areas are separated by bulkheads. Each of these has several areas, each supplied by its own air delivery and discharge ducts from at least one ventilation system. At least some of the areas separated by bulkheads are designed as separate ventilation areas, each of which has its own ventilation system and whose air delivery and discharge ducts connected to this ventilation system are not laid through the adjacent bulkheads into adjacent separate ventilation regions, but are laid exclusively within its separate ventilation region.

21 Claims, 9 Drawing Figures

SELF-CONTAINED VENTILATION SYSTEM UNITS FOR SUPPLYING SPACES BETWEEN BULKHEADS WITH INDIVIDUALLY CIRCULATED VENTILATION AIR

CROSS REFERENCE TO CO-PENDIING APPLICATIONS AND RELATED ISSUED U.S. PATENT

Co-pending application Ser. No. 580,611, now U.S. Pat. No. 4,658,747, issued Apr. 21, 1987 filed on Feb. 16, 1984, entitled "Ship With Several Decks Having Longitudinal and Lateral Support Elements Arranged in a Grid", corresponding to Federal Republic of Germany Laid Open Patent Application No. P 33 05 322, published on or about Aug. 16, 1984; co-pending application Ser. No. 716,566, now U.S. Pat. No. 4,630,561, issued Dec. 23, 1986 filed on Mar. 27, 1985, entitled "A Ship Having Standardized Access Ways", corresponding to Federal Republic of Germany Laid Open Patent Application No. P 34 11 299, published on or about Sept. 27, 1985; and U.S. Pat. No. 4,579,073, issued Apr. 1, 1986 to Sadler, et al., entitled "Interchangeable Mounting System For Weapon/Navigational Units, etc., on Ship Decks", are all assigned to the same assignee as the instant application and are incorporated herein by reference as if the texts thereof were fully set forth herein.

BACKGROUND OF THE INVENTION

1. Field of the Invention:

The present invention relates generally to ventilation on ships and, more particularly, to ventilation systems for the interior portion of ocean going ships having several decks.

2. Description of the Prior Art:

Generally, ships with several decks and several areas lying one behind the other in the longitudinal direction of the ship, separated by bulkheads, use a central ventilation system, preferably which includes at least one air delivery ventilator, one recirculation ventilator, one air heater and one air cooler. Generally, there is also an air conditioning apparatus, to give the air inside the ship a certain humidity, for example. On military ships, there is generally also an ABC (atomic, biological, chemical) filter set located ahead of the air delivery ventilator which prevents the penetration of radioactively-contaminated air inside the ship. A typical ventilation system for a ship is described in U.S. Pat. No. 4,428,318, issued Jan. 31, 1984, entitled "Ventilation Arrangement For A Cargo Ship", which patent is incorporated by reference as if the entire contents thereof were fully set forth herein.

Although the central ventilation system is located between two bulkheads at a central point of the ship, the ventilated spaces are distributed throughout the ship between various bulkheads. Therefore, on ships of the prior art, it is inevitable that air ducts in the longitudinal direction of the ship must be laid through the bulkheads. But this has the serious disadvantage, especially on a warship, since the hot gases can rapidly spread throughout the entire ship through the inflow and exhaust ducts, such as, in the case of a fire caused by combat damage. Of course, attempts have been made to confront this problem by installing heavy safety valves in the inflow and exhaust ducts in the area of the bulkheads, but such measures are relatively expensive, and the danger exists that in case of a fire, the closing mechanism on the safety valves may fail or the ventilator valves located in the area in question may no longer be accessible, so that in spite of their presence, the spread of the fire inside the ship through the ventilation system could not easily be prevented.

OBJECTS OF THE INVENTION

An object of an embodiment of the invention is the creation of a ship of the type described above, whose ventilation system takes into consideration both the requirements of air conditioning and the safety of the ship in case of a fire.

It is another object of an embodiment of the invention to contain and eliminate fumes.

It is yet another object of an embodiment of the invention that the ship is also designed so that space requirements on board and structural aspects are also taken into consideration.

It is a further object of an embodiment of the invention to create a ventilation system without excessively increasing the expense and the space requirements.

It is a yet further object of an embodiment of the invention to make efficient use of the space conditions on the ship.

It is still a further object of an embodiment of the invention to prevent the spreading of fires through the bulkheads.

It is still another object of an embodiment of the invention to assure that, in case of a bombardment and a hit taken in the ventilation system, the ventilation system of the entire ship will not fail.

SUMMARY OF THE INVENTION

The embodiments of the invention achieve these objects in that at least some of the areas separated by bulkheads are designed as separate ventilation areas, each of which has its own ventilation system, and whose inflow and exhaust ducts connected to this ventilation system are not laid through the adjacent bulkheads into neighboring separate ventiltion areas, but are laid exclusively within their own separate ventilation area.

The invention specifically provides that each ventilation system assigned to a separate ventilation area is installed inside the separate ventilation area.

The invention takes advantage of the fact that between the fireproof bulkheads of a ship, there are already spaces which are watertight and frequently also airtight. Any ventilation connection to the neighboring areas can be effectively eliminated by the bulkheads so that, preferably, each of these areas between the bulkheads can be assigned its own ventilator, its own duct system and, specifically, its own air intake capability.

If a fire should occur in one of the separate ventilation areas, then in any case it will not be transmitted by the ventilation system into neighboring separate ventilation areas. Fire fighting, for example, by shutting down the ventilation system inside a separate ventilation region, is thereby significantly facilitated, because the shutdown in one of the separate ventilation regions in no way interferes with the ventilation of the other areas between the bulkheads. With a central ventilation system, on the other hand, a decision must be made whether the ventilation of most of the neighboring sections will be eliminated by shuttting down the ventilation system, or whether the continued operation of the ventilation system will encourage the spread of the fire.

The shutdown of the ventilation system can, under certain circumstances, have catastrophic consequences for certain parts of the ship, where temperature-sensitive equipment or other items are installed as well as to personnel thereaboard.

In accordance with the invention, on the other hand, if there is a fire inside a separate ventilation area, the ventilators in all the other areas continue to operate and continue to provide satisfactory ventilation.

Another important advantage of the ventilation system according to the invention is that, in case of a projectile strike which damages a ventilation system, all the other ventilation systems continue to operate, so that the ventilation fails only in one section between the bulkheads.

The spread of fumes in the longitudinal direction of the ship is prevented in case of a fire as a result of the division of the ventilation system into zones between the individual bulkheads, according to the invention. The failure of important electronic systems is also prevented because of insufficient ventilation. It is important that, since there are no air ducts laid through the bulkheads, the elimination of the bulkhead penetrations which would otherwise be necessary, for example, for tubes and cables, means that a design which provides imperviousness to fumes and ABC substances can also be achieved.

While on ships of the prior art, it is customary to separate the air conditioning system used for normal ventilation from the protective ventilation system required in the presence of ABC substances so that, to some extent, there must be two different ventilation components, the invention proposes that the air conditioning system used for normal ventilation and for protective ventilation be operationally coupled to one another. This means that the same ventilators, the same ducts and the same accessory air conditioning equipment can be used for normal ventilation and for ABC protection. Therefore, the heavy and expensive duplication of ventilation equipment, rapid-closing valves and ducts, which are necessary on ordinary protective air systems, can be eliminated. The additional decentralization of the ventilator spaces, also provides fire protection as described above.

In case of a fire, the ventilation system responsible for the section in question can be turned off immediately, without any ventilation effects on other sections, which limits the spread of fumes within the section if the valves located preferably in the vertical ventilator ducts are closed promptly, and provides secure protection against the spread of the fumes beyond the deck section in question.

In the exhaust air ducts, there are also closable standard connection pipes for portable ventilators, whereby there can be an optimal elimination of fumes on the deck level even if the blowers fail or are turned off. This presumes, however, that the fire has already been extinguished and that the ventilator ducts are undamaged. If the latter is not the case, the portable ventilators must be used just as in the ships with ordinary systems (such as via the use of pressure and suction hose connections).

One embodiment of the invention is characterized by the fact that, specifically in the forward quarter of the ship, some of the areas located between the bulkheads arranged in sequence are combined into a common separate ventilation area. Such an arrangement is based on the knowledge that hits from missiles which result in fires are relatively rare in the forward quarter, so that the preferable combination of several areas into one expanded separate ventilation area often represents no disadvantage there. Amidships and astern, on the other hand, the division according to the invention into sequentially-arranged separate ventilation areas can be realized to its full extent.

A particularly compact arrangement is characterized by the fact that each separate ventilation area exhibits a shaft which runs through all the ventilated decks, in which the vertical inflow and exhaust ducts are located, which is connected to the ventilation system and from which the horizontal inflow and exhaust ducts branch off into the individual decks. In the vertical direction, therefore, in each separate ventilation area, thre is only one single vertical ventilation connection between the decks.

A particularly preferred embodiment is characterized by the fact that the ventilation system is located in a separate standardized container or on a standardized pallet aboard the ship.

In this manner, standardized ventilation systems can be made available, which can be used in each of the separate ventilation areas. Therefore, ventilation systems according to embodiments of the invention can be manufactured and installed extremely economically because it then practically becomes a question of standardized functional units.

The advantage of using ventilation components in the form of standard containers or standard pallets, however, does not consist only of the possibility of completely manufacturing these components prior to their installation in the ship, but it also offers the capability of keeping the size of the overall ventilation system down to an extremely small size, because all of the components can be combined in an extremely compact arrangement in the container.

In this manner, the total space required for the numerous ventilation systems distributed over the ship according to the invention need not be any larger than the space required for central ventilation systems of the prior art and, specifically, if, according to the invention, the air conditioning and protective air systems are combined into one ventilation system. In spite of the requirement for numerous ventilation systems distributed over the ship, the construction expense is lower than for a central ventilation system, and the design of the individual components of each ventilation system can be adapted to the significantly smaller air consumption of each individual separate ventilation area.

The invention therefore concerns a ventilation system which does not require practically any more space than or greater manufacturing cost than ordinary central ventilation systems, but which is also far superior to a central ventilation system both in the sense of protection against the spread of fire and protection against impacts during bombardments.

The adaptability of the ventilation system according to embodiments of the invention to the spatial conditions on a ship is further improved by the fact that the separate ventilation areas in the upper portion of the ship, specifically in the region of the superstructures, at least partly do not lie exclusively between two neighboring bulkheads, but extend fore-and-aft by preferably not more than one bulkhead interval beyond the limiting bulkheads in the lower area. Since the division of the ship by bulkheads in the area of the superstructures is no longer as important as in the hull of the ship itself, the basic idea of the creation of separate ventilation areas in the vicinity of the superstructures can be applied more universally than in the lower region of the ship, which is enclosed by transverse bulkheads.

It is specifically possible that there are also horizontal separate ventilation areas in the superstructures, which do not communicate in terms of ventilation with the separate ventilation areas located underneath, and which all have their own ventilation systems and their own inflow and exhaust ducts.

The horizontal, separate, ventilation areas extend in the horizontal direction over at least two bulkheads. In all cases, howver, the separate ventilation areas should extend over the whole breadth of the ship. Basically, however, it would also be possible to create separate ventilation areas within the ship, divided by fireproof walls running in the longitudinal direction of the ship.

It is particularly advantageous if the shaft running through the various decks is located near a bulkhead of the ship, because here is interferes least with easy accessibility to the rooms.

The standardized container or the standardized pallet is preferably located on the ship's first deck. The standardized container can be installed in this deck most easily during construction of the ship. In addition, the distance from the decks located in the superstructures and the decks located in the hull is approximately equal, so that the recirculated, fed-in or exhausted air need not travel an excessively long path to reach its destination.

It is also advantageous if the standardized container or the sandardized pallet is located near a bulkhead of the ship. In this manner, the standardized container is located in an area of the ship where it interferes least with access to the individual decks for the installation of other equipment.

Finally, a particularly preferred practical embodiment is characterized by the fact that the standardized container or the standardized pallet is located near the vertical shaft and preferably inside it. In other words, the standardized container and the shaft should be practically adjacent to one another.

The combination of air conditioning and protective air systems can be achieved in accordance with the invention so that each standardized container or each standardized pallet includes an ABC filter set, an inflow system feeding the ABC filter set, and an air conditioning apparatus connected to the inflow. The air conditioning equipment thereby preferably generally includes a recirculating ventilator, an air heater, an air cooler and a treatment apparatus.

Both during normal air conditioning and also in the case of protective air supply, operations can therefore be conducted with the above-mentioned components installed in a compact and spacesaving manner in the standardized container or on the standardized pallet.

It is also appropriate if each standardized container or each standardized pallet has standard dimensions, preferably 2.15×2.4×3.0 meters.

As a result of this configuration, the ventilation system according to the invention can be completely integrated into a component system equipped with appropriately standardized containers.

The location of the entire ventilation system in standardized containers or on standardized pallets makes it possible to mount each standardized container or each standardized pallet on shock absorbers in the ship.

The advantages of the invention do not merely extend to the prevention of the spread of fires inside the ship. During the extinguishing of fires with various extinguishing agents, serious secondary damages are also avoided, which, among other things, can be due to the fact that during the extinguishing, corrosive chlorine-hydrogen compounds are formed. The invention effectively prevents these compounds from spreading throughout the entire hull of the ship.

All the other ventilation systems on the ship can continue operation with no problems as a result of a failure of a single ventilation system caused by a bombardment or a fire, and damages resulting from insufficient ventilation, for example, of computer rooms, can be effectively prevented.

The invention has a particularly favorable effect where ventilation is conducted with only a low proportion of fresh air, for example 40%, while 60% of the air blown into the individual rooms of the ship is recirculated through the air conditioning system and blow back into the air circuit. It is precisely this recirculation in ships equipped with central ventilation systems which leads to the spread of fires and highly toxic gases.

In ships which are equipped, for example, with a long-term protective air conditioning system, the proportion of fresh air used can drop to as low as 10%. Here, therefore, 90% of the total amount of air is recirculated, so that the division of the ship into numerous separate ventilation areas, according to the present invention, has a particularly favorable action in this case.

According to embodiments of the invention, the heavy and expensive duplication of equipment with ABC ventilators and rapid-closing valves, such as those which are customary on ordinary ships with air conditioning and protective air systems, is usually no longer necessary.

Valves should be installed in the vertical ventilation ducts, however, to prevent the fire from spreading in the vertical direction into the individual separate ventilation areas.

According to the invention, all the equipment necessary for the ventilation, emergency and air conditioning system for one separate area can be installed in a standardized container rack with the dimensions 2.15×2.44×3 meters. The necessary maintenance space on at least two sides of the container is about 0.7 meters.

In a ship constructed using the functional unit system, all the containers can be introduced into the deck of the ship and installed there through the openings already present for the introduction of machines and/or weapons. In addition, structural supply ducts are used, which ducts are located on the transverse or longitudinal bulkheads and in which all the necessary types of air (recirculated air, exhaust air, cold and hot air) are combined in a ventilation duct divided into four parts. These ducts can be placed as a function of the position of the ventilation system container as early as in the definition phase, which has a positive effect, among other things, on the preliminary coordination of construction and design.

In this context, it is important that when the ship is closed up for battle, operating and control rooms which are used by a large number of personnel and which operate with a high proportion of fresh/protective air (20–25 cubic meters per hour per person) are not concentrated in one section, since the amount of fresh/protective air required could exceed the capacity of the associated ABC filter system.

Here, an appropriate distribution of the rooms with a high proportion of fresh air/protective air over the entire length of the ship is important.

By means of the central supply ducts in a decentralized ventilation system, a clear, simple layout of the distribution ducts is possible, for which standard "Euronorm" tubes, which follow the European standard set for tubes, can be used. This means that space below the decks and on the bulkheads, often desperately required for other supply systems, is created. This makes possible, among other things, as early as in the design phase, a more precise construction and coordination schedule than is currently the case with conventional ventilation systems.

In the design, as a result of the elimination of the complicated layout, erection and coordination of conventional ventilation spaces and ducts, approximately 10,000 hours of design work can be saved. The same number of hours can also be saved in the fabrication and installation stages.

On a decentralized and containerized long-term protective air conditioning system, the demands of ship safety, fire protection, containment of smoke, elimination of fumes and tightness are virtually fully met.

As a result of the absence of horizontal penetrations or horizontal ventilation ducts, protection against leaks and thus buoyancy are also increased.

The containerization of long-term protective air conditioning systems offers the following advantages:

parallel fabrication;

equipping and testing of the containers on long under shop conditions;

fast and easy on-board installations;

clear interfaces between the shipyard (the general contractor) and the air conditioning systems company (the subcontractor);

compact combination of all the necessary subsystems into a fully-operational total system occupying the minimum amount of space, and thus saving a significant amount of space;

elimination of the elastic mounting of each individual piece of equipment, and thus the possibility of a rigid pipeline between each ventilation system or each standardized container or each standardized pallet;

standardization and improved logistics, making possible an easy replacement of defective system units;

correspondingly shortened dock time for maintenance;

reduced personnel requirements in on-board operation;

suitability for new control technologies, for example, data bus, screen technology; and the cost reductions resulting from all the above-mentioned advantages.

In spite of the above-mentioned standardization of the ventilation system containers and most of the equipment, the capacities of the system components can be modified in response to the wishes of the customer or as a function of the size of the ship and the amount of air required, without taking up additional space. This becomes possible, among other reasons, because of the complete and optimal utilization of the container space available for the equipment to be integrated.

Since the embodiments of the invention are primarily concerned with rack containers, accessability does not present a problem. Any service operations which may be necessary can be performed from two sides. The containers are designed so that no more than 0.7 meters of service room is necessary on these sides of the standard containers.

While, according to the embodiments of the invention, the horizontal tubes are to be so-called "Euronorm" tubes (flexible aluminum tubes), welded tubes or shafts are preferably used for the vertical ducts.

To dampen the noise of the ventilation system, one advantageous refinement is characterized by the fact that each ventilator unit is installed in a closed room which is acoustically lined on all sides and is located on the deck in question, and that the recirculation ducts empty into this room, while the recirculation suction opening of the ventilation system or the standardized container or the standardized pallet has its intake inside this room. This embodiment also has the advantage that, during the installation of the standardized container, consideration need only be given to the connections for the outgoing delivered air and the exhaust air.

Another advantage of the invention is the fact that all the duct cross sections can be kept significantly smaller than for longitudinal ducts which often run all the way through the ship.

If the invention is used primarily on long-term protective atmosphere systems, it can also be used more generally on so-called open ventilation systems.

BRIEF DESCRIPTION OF THE DRAWINGS

The embodiments of the invention are described below with reference to the drawings, in which.

DETAILED DESCRIPTION OF THE PREFERRED EMBODIMENTS

In all the figures, the same reference numbers are used to identify the substantially corresponding parts.

Figure 1:
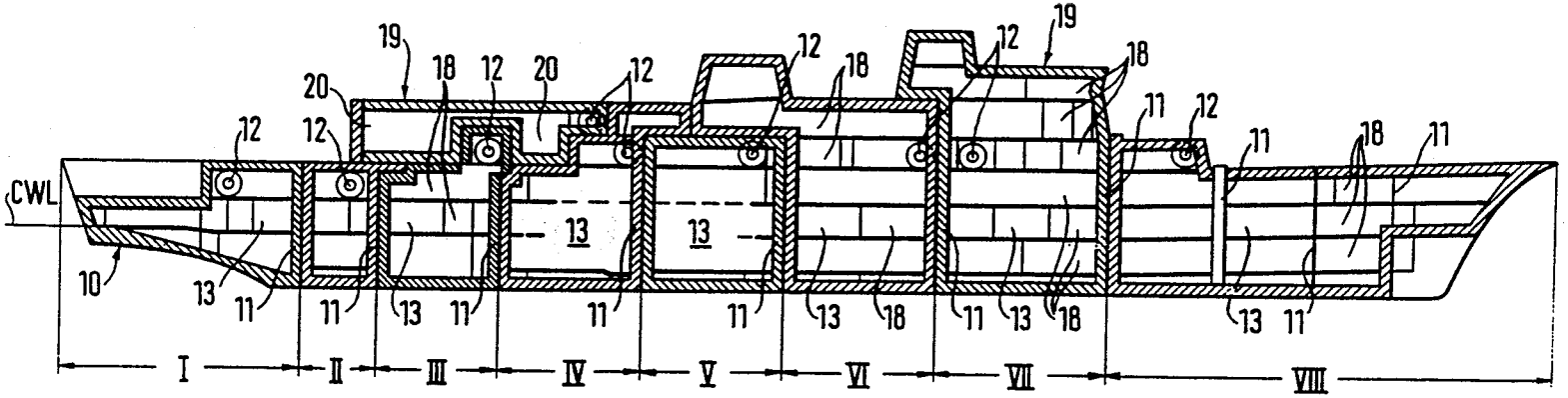
FIG. 1 shows a schematic vertical longitudinal section through a ship according to an embodiment of the invention.

In FIG. 1, transverse bulkheads 11 on a ship are displayed at cetain intervals in the longitudinal direction of the ship. The bulkheads 11 extend entirely across the ship and make the enclosed spaced therebetween preferably watertight from one another. Up to a specified range above the construction water line (CWL), the bulkheads 11 preferably must be watertight, to prevent water from spreading into the adjacent bulkheaded rooms in case of a leak.

According to an embodiment of the invention, separate ventilation areas 13 are formed between the bulkheads 11, which are supplied by individual ventilation systems 12 located thereabove or at upper portions thereof for supplying fresh or recirculated air. In the forward area of the ship, several bulkhead sections are combined into a common separate ventilation section 13*a*. Over the length of the hull 10, there are sections I, II, III, IV, V, VI, VII and VIII of differet lengths, in each of which has a separate ventilation area 13 with a corresponding ventilation system 12.

Each separate ventilation area 13 extends vertically over several decks 18 of the ship, or over all the decks.

The separate ventilation areas 13 of the Sections VI and VII are displaced horizontally in the vicinity of the superstructures 19, that is, in the vicinity of the upper deck, in relation to the corresponding bulkheads 11 so that they extend to the areas above the neighboring separate ventilation areas 13. This is possible because, in the area of the superstructures 19 of the ship, the bulkheads need no longer be watertight, so that penetrations can be made here. In this manner, spaces, for example, passages, which must be accessible to personnel, can be combined into appropriate separate ventilation areas 13, which are still separated from the neighboring separate ventilation areas 13.

The separate ventilation areas 13 in Section IV extends in the vicinity of the superstructures 19 somewhat beyond the separate ventilation area in Section V.

Finally, in the aft portion of the superstructures 19, there is also a horizontal separate ventilation area 20, in which there is also a separate ventilation system 12, and which is located exclusively above the hull 10 of the ship itself.

The hatched walls of each separate ventilation area 13 are watertight and gastight. This property must also be taken into consideration for any lines which must be routed through the individual walls. In no case do ventilation ducts extend through the hatched walls of the separate ventilation areas 13, so that overall, there are nine completely independent ventilation areas 12 within the ship, which in no way communicate with one another.

Figure 2:
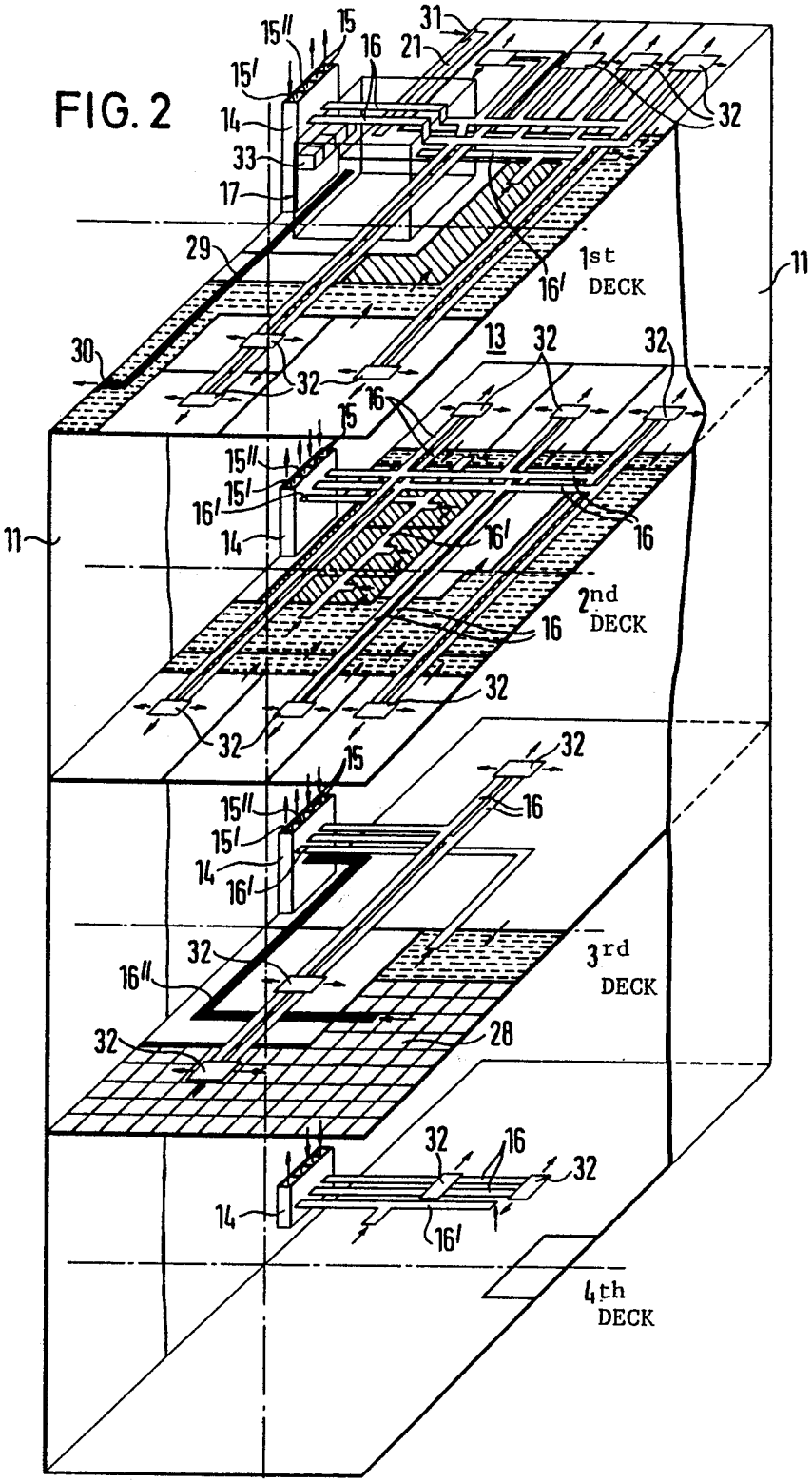
FIG. 2 shows a schematic extended pespective of an individual separate ventilation area of a ship according to an embodiment of the invention, specifically in the area of the lower deck.
Figure 3:
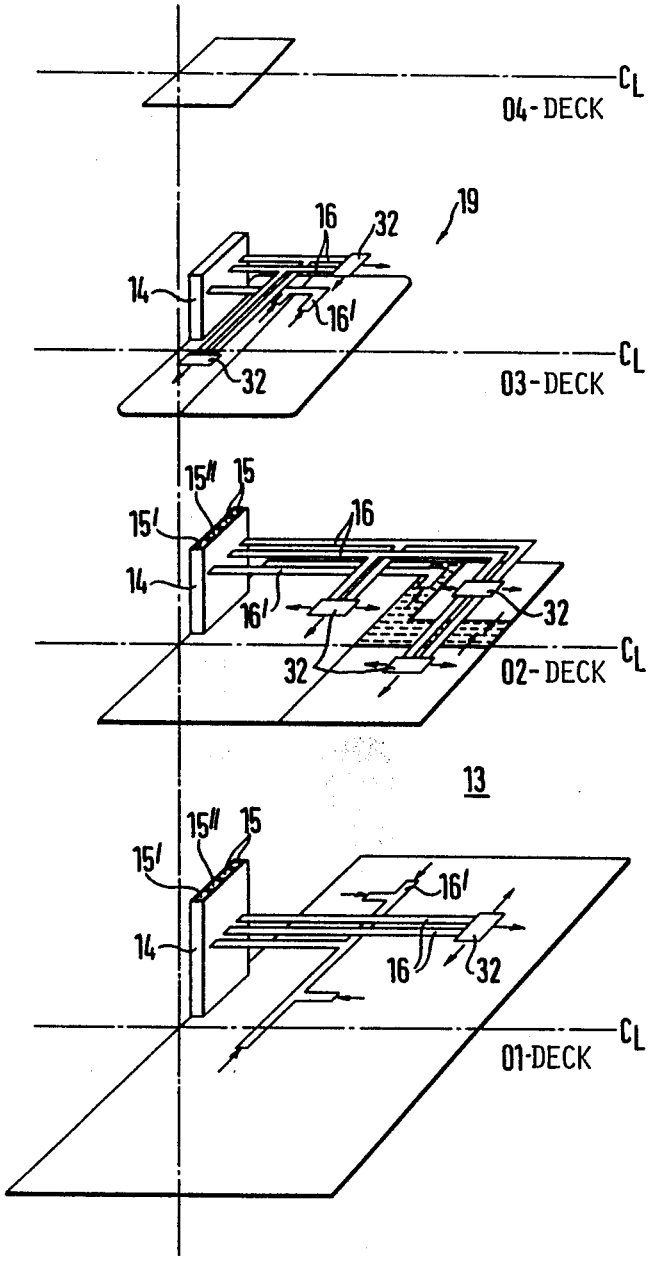
FIG. 3 shows a corresponding perspective of the same separate ventilation area in the upper deck.
Figure 4:
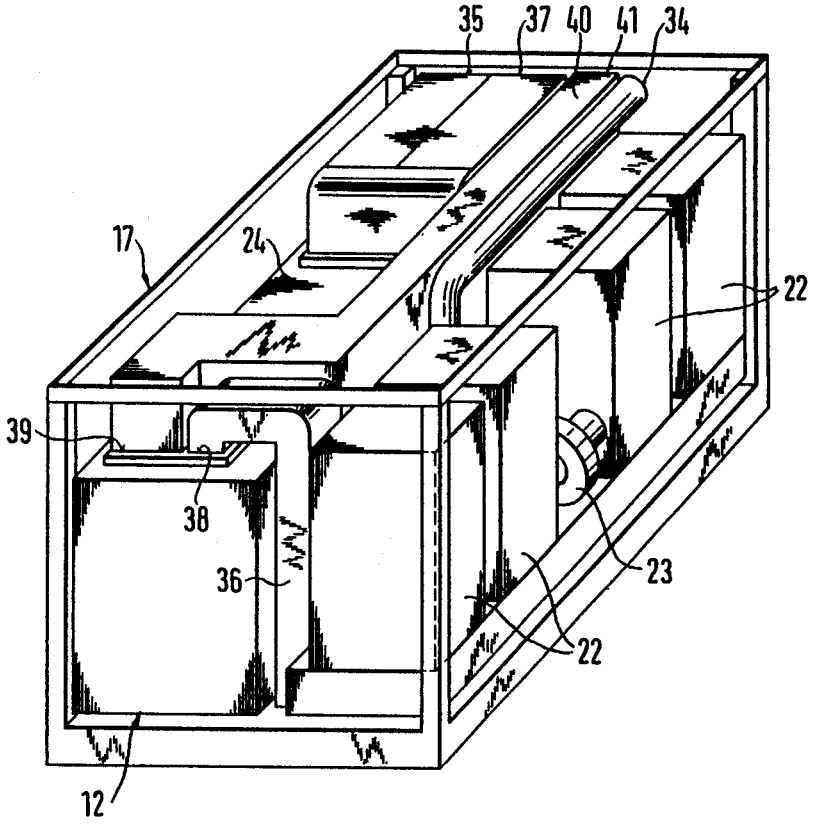
FIG. 4 shows a schematic perspective of a ventilation system according to the invention for a ship according to an embodiment of the invention, installed in a rack-shaped standardized container.
Figure 7:
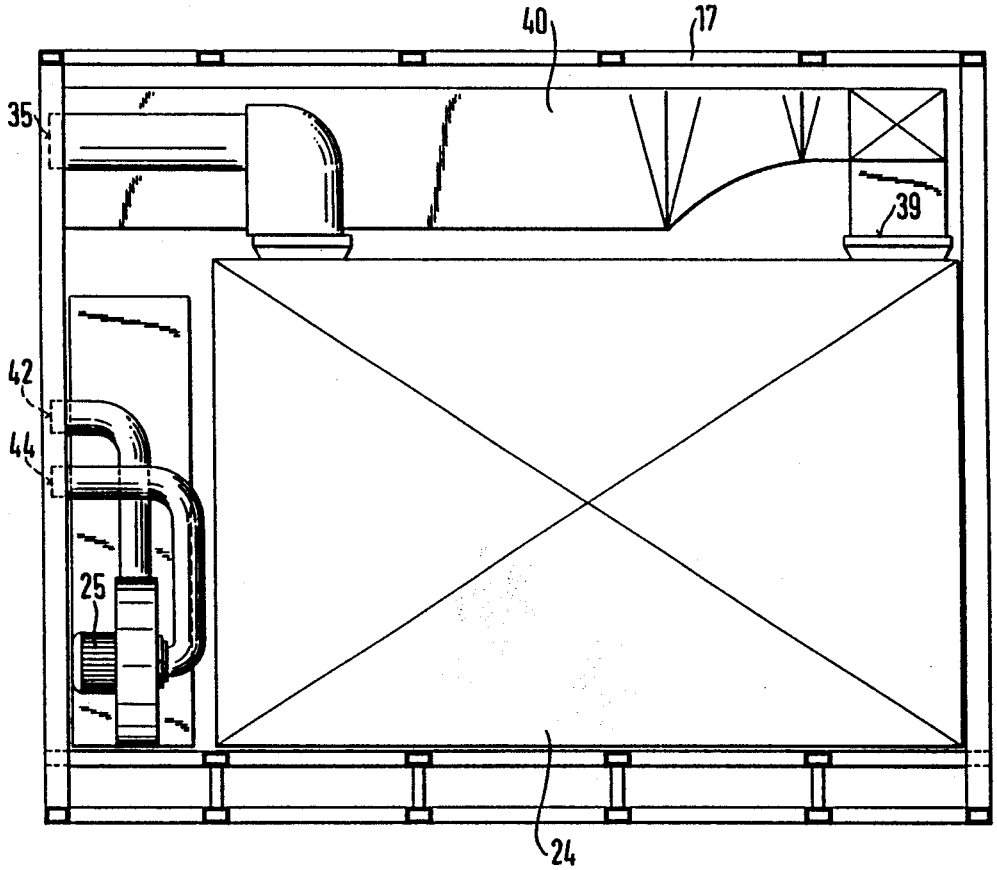
FIG. 7 shows a side view of the system in FIG. 5, in the direction of the Arrow VII in FIG. 5.

As shown in FIGS. 2 and 3, each separate ventilation area 13, limited fore and aft by bulkheads 11 shown only partly and laterally by the sides of the hull (not shown), contains a rackshaped standardized container 17, which will be described below with reference to FIGS. 4 and 7, and in which the ventilation system not shown in FIG. 2 is installed.

The standardized container 17 is located in the vicinity of the aft bulkhead 11 of the ship, preferably in a closed room, for example, on the first deck of the hull 10. Between the aft bulkhead 11 and the container 17, there is a vertical shaft 14 with a rectangular cross section, which extends vertically upward to 03-DECK of FIG. 3, and downward to the 4th deck (or 01-DECK) of FIG. 3. Within the shaft 14, next to one another viewed abeam, there are two vertically-running inflow air ducts 15, a recirculating air duct 15', and one exhaust air duct 15''. Of the two inflow air ducts 15, one is provided for the transport of cold air and the other for the transport of heated or hot air. The recirculating air duct 15' is used to remove the used air from the rooms, and the exhaust air duct 15'' is used to remove the waste air from a room 28 in the vicinity of the third deck where, for example, toxic, combustible, or explosive gases can form, for example, in torpedo rooms. These toxic, combustible or explosive gases are conducted via the horizontal exhaust air duct 16'' connected to the room 28 and the vertical exhaust air duct 15'' to the ventilation system provided in the standardized container 17, which prevents this dangerous air from being fed into the circulating air system. They are instead fed to an exhaust air line 29, which empties at 30 on the open deck in the final bulkhead of the superstructure 19 of the ship, so that the waste air in question is removed completely from the hull 10.

In each deck, there is a system of horizontal inflow air ducts 16 for hot or cold air and a system of horizontal recirculation ducts 16' for the recycling of the used room air, either directly into the standardized container 17 (first deck) or into the shaft 14.

Also connected to the standardized container 17 is an outside air suction tube 21, which also empties at 31 in the final bulkhead of the superstructure, to suck in fresh air from the outside.

The operation of the ventilation system illustrated schematically in FIGS. 2 and 3 is as follows:

By the shortest path, fresh air is sucked in through the outside air intake 21 and is added to the recirculated air in the desired amount in the ventilation system 12 located in the standardized container 17.

The prepared air is conducted via the vertical inflow ducts 15 into the individual decks, and from there via horizontal inflow ducts 16 connected to the vertical inflow ducts 15 to the destinations in the individual decks, where the hot or cold air exits from mixing boxes 32.

The return air or the air to be replaced from the rooms travels via spills in the room ceilings or walls (not shown) into the passages indicated by dotted lines, from which it is sucked via the horizontal recirculation ducts 16' and reaches the vertical recirculation ducts 15'. The vertical recirculation ducts 15' are again connected to the ventilation system 12 housed in the standardized container 17, which mixes the recirculated air (except for that originating from the rooms 28 marked by crosses) with fresh air from the outside air suction tube 21 in the desired percentage, for example, 10%, and then returns it to the circuit.

The horizontal inflow air ducts 16 in the first deck are not connected to the container 17, but to the shaft 14, whose inflow air ducts 15 for their part are connected to the ventilation system 12 in the container 17. This connection is provided by a conection sleeve 33. The horizontal recirculation duct 16' in the first deck, however, is connected directly to the container 17 or to the ventilator room 26, explained below with reference to FIGS. 8 and 9.

For washrooms and toilets, which are indicated by hatching in the second deck, the incoming air is delivered to the rooms through spills from the passages indicated by dotted lines, and from there is sucked directly out via the recirculation ducts 16' for treatment in the standardized containers 17.

The duct 29 is also used to transport the proportion of exhaust air, corresponding to the 10% fresh air added, to the outside via a relief valve (50 mbar).

In case of a fire, or after the extinguishing of a fire, the smoke formed is sucked in by the recirculation ducts 15' and 16' after the establishment of a bypass circuit in the container 17, and transported outward via the outside air intake 21 or the exhaust air duct 29.

Each of the separate ventilation areas 13 of the ship according to FIG. 1 is constructed as shown by FIGS. 2 and 3, whereby only the spatial arrangement of the lines need be adapted to the special dimensions of Sections I to VIII and the horizontal separate ventilation areas 20.

As shown in FIGS. 4 to 7, the rack-shaped standardized container 17 houses in a compact arrangement an intake tube 34 connected to the outside air intake 21 (shown in FIG. 2), an ABC inflow tube 23, and an ABC filter set 22 connected to the latter. These components are arranged in a series on one side of the standardized container 17. The filtered air is conducted out of the final ABC filter via a duct 36 parallel to the ABC filter set 22, to an air conditioning apparatus located on the other side of the standardized container 17 parallel to the ABC filter set 22.

In the air conditioning system 24, there is a recirculation ventilator, an air cooling unit, an air heater and an air conditioning apparatus.

Figure 5:
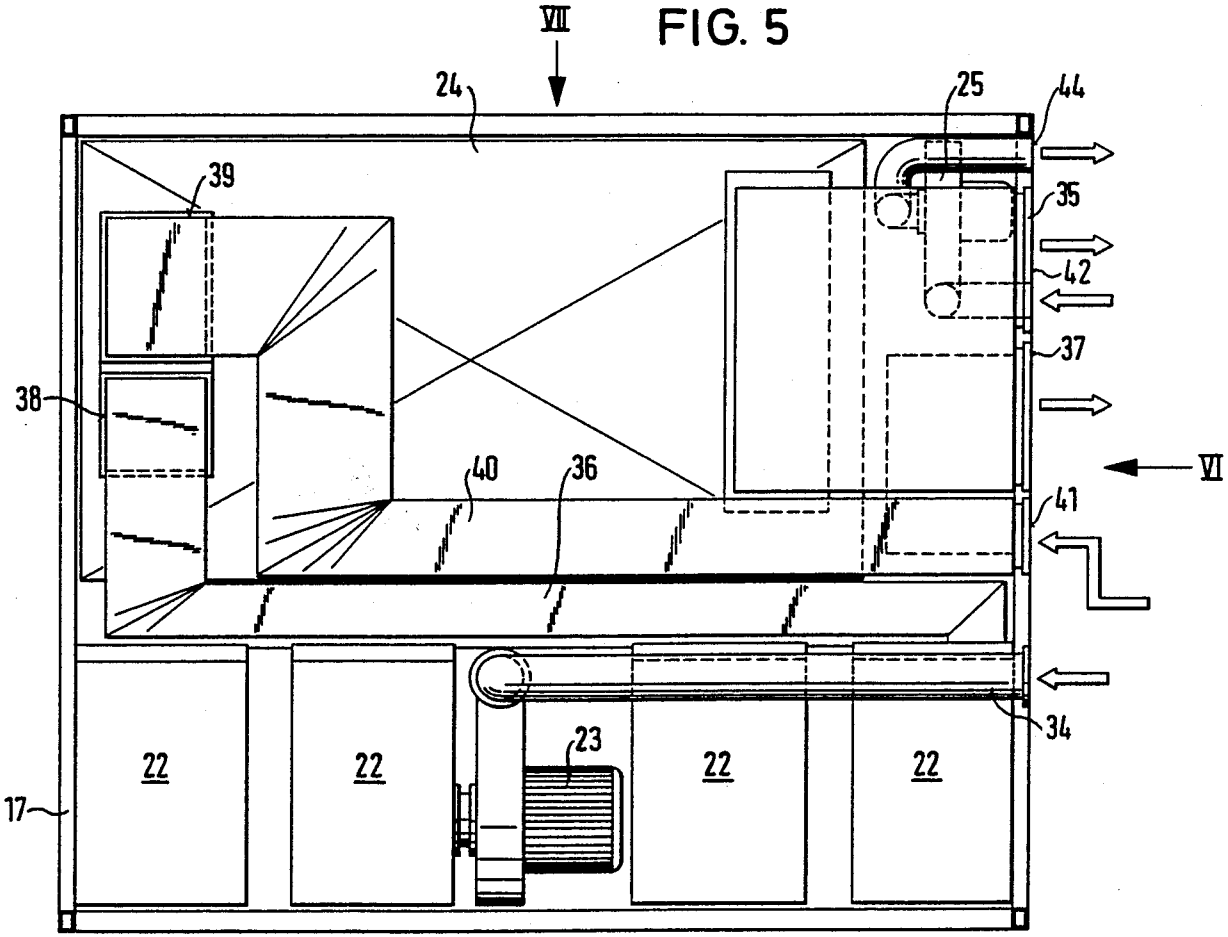
FIG. 5 shows an overhead view of the system as shown in FIG. 4.
Figure 6:
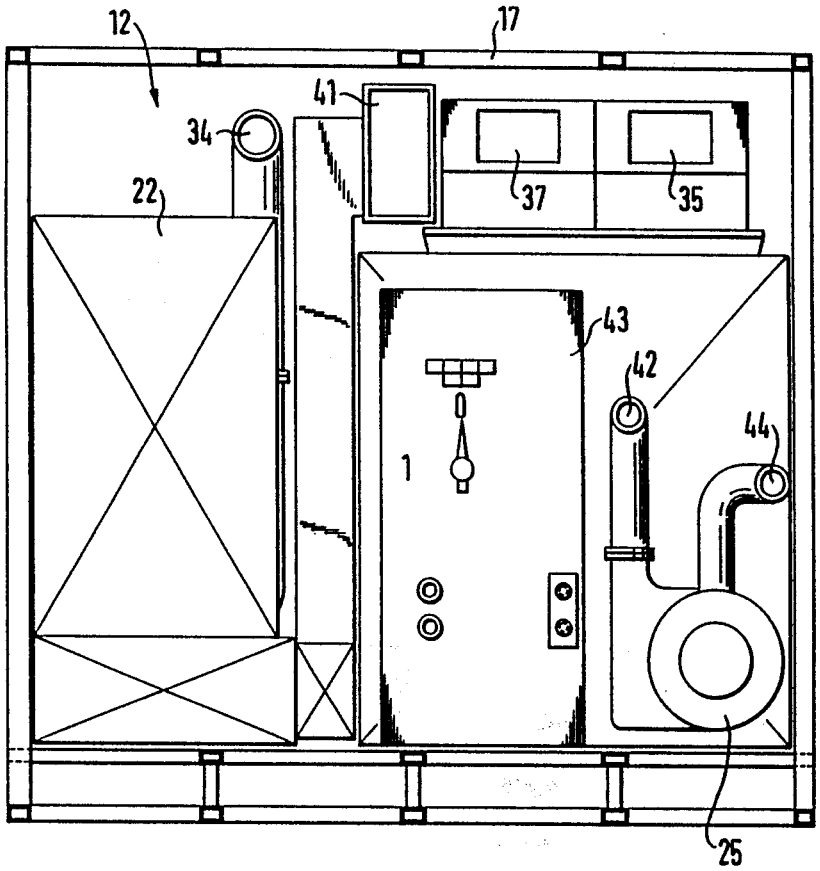
FIG. 6 shows a view of the system shown in FIG. 5, in the direction of the Arrow VI in FIG. 5.

As shown in FIGS. 5 and 6, all of the air intake and exit openings are on one end side of the standardized container 17.

The air conditioning apparatus 24 exhibits, on its end, a hot air outlet pipe 35 and, next to it, a cold air outlet pipe 37 which are to be connected to the corresponding vertical inflow air ducts of the shaft 14.

Finally, on the opposite side, like the ABC filter set 22, in the corner of the standardized container 17 facing the connection side, there is an exhaust ventilator 25, which exhibits an intake pipe 42 connected to the vertical exhaust air duct 15'' so that it completely sucks the air from the room 28 containing the dangerous gases in the third deck (as shown in FIG. 2), and exhausts it to the outside via an outlet pipe 44 into the exhaust duct 29.

By means of automatic relief valves (not shown) which are located in the separate ventilation regions, the used air conditioning air (10% corresponding to the fresh air protection air added) at 50 mbar is conducted to the outside.

Finally, on the connnection side (as shown in FIG. 6) of the standardized container 17, there is a control and connection panel 43 for the operation of the individual components.

As shown in FIGS. 4 to 7, the standardized container has a rectangular shape.

Figure 8:
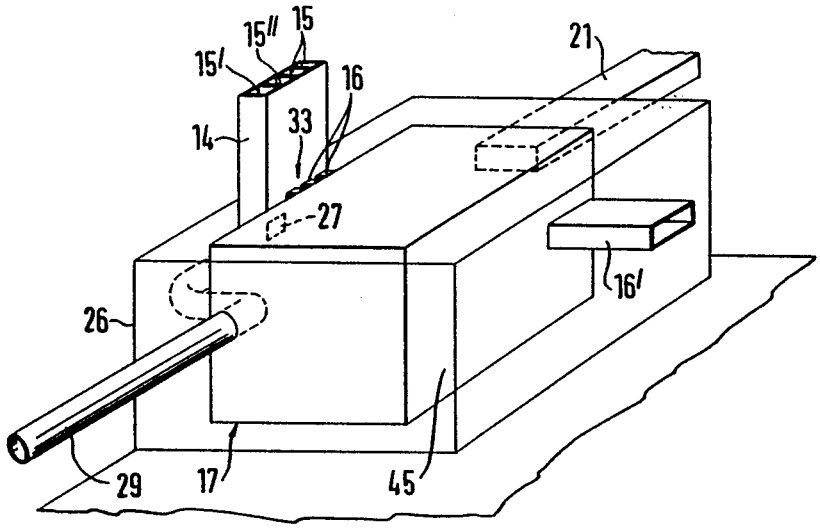
FIG. 8 shows a schematic perspective view of the system of a standardized container according to the embodiment of the invention containing the ventilation system, in a closed ventilator room.
Figure 9:
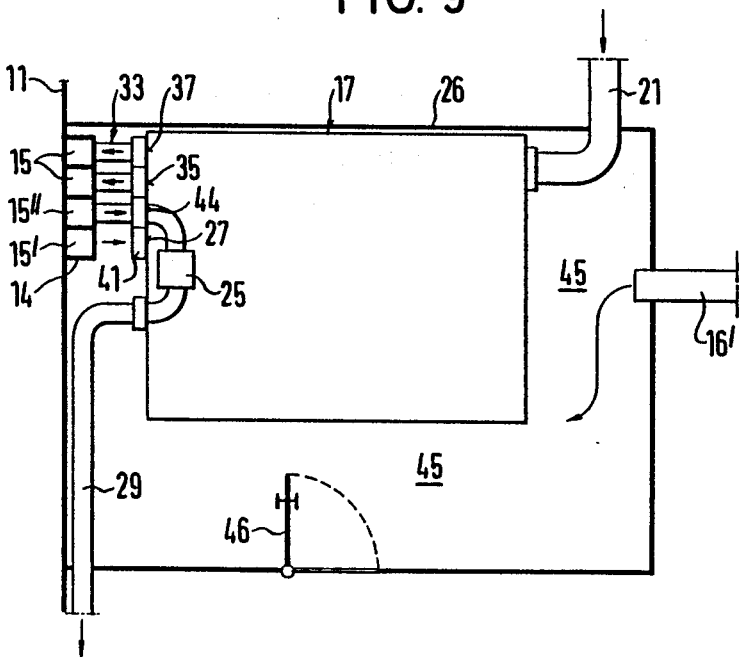
FIG. 9 shows an overhead view of the system as shown in FIG. 8.

In the embodiment illustrated in FIGS. 8 and 9, the standardized container 17 described with reference to FIGS. 4 to 7 is installed in an acoustically lined ventilator room 26 closed on all sides, which is also rectangular, but is longer, wider and higher than the container 17, so that between the walls and the cover of the room 26 and the sides of the standardized container 17 there remains a clear space, which is accessible in the areas 45 on two sides of the container 17 via a door 46.

While the delivery ducts and the exhaust duct are conducted from the container 17 into the vertical shaft 14 by means of the connection piece 33 through the room 26, the vertical recirculation duct 15' and the horizontal exhaust duct 16' of the first deck empty at the walls of the room 26, while the container 17 exhibits an exhaust intake opening 27 in one of its walls, located on the connection pipe 41. The air conditioning apparatus 24 in this manner sucks in the air located in the blower room 26, which for its part flow through the recirculation ducts 15' and 16' into the blower room 26. The room 26 therefore requires a damping of the blower noises.

It should also be noted that the arrangement of the various connection pipes at the container 17 (shown in FIGS. 8 and 9) differs from that of the ventilation container shown in FIGS. 4 to 7, although the functions are identical.

The invention as described hereinabove in the context of the preferred embodiments is not to be taken as limited to all of the provided details thereof, since modifications and variations thereof may be made without departing from the spirit and scope of the invention.

What is claimed is:

1. A ship with an air conditioning system, said ship comprising a plurality of vertically-shaped decks and a ship bottom within a hull, said decks comprising an uppermost deck and at least one lower deck, said at least one lower deck comprising at least one deck adjacent said uppermost deck;

said hull having a longitudinal direction and a transverse direction;

a plurality of bulkheads disposed vertically within said hull for dividing said hull into a plurality of separate spaces one behind the other along said longitudinal direction of said hull;

first means for providing air for ventilation solely to at least a first of said plurality of separate spaces between at least two of said bulkheads;

said first air providing means having ducting;

first means for conducting and removing ventilation air solely to at least said first space;

second means for conducting and removing ventilation air;

said first air conducting and removing means disposed for providing air solely to said first of said plurality of separate spaces;

said second air conducting and removing means being disposed to conduct and remove ventilation air solely from at least a second of said plurality of said separate spaces other than said first of said separate spaces; and said first air conducting and removing means having a portion thereof disposed solely between and other than through any of said at least two bulkheads of said at least first space, whereby air conducted into and discharged from said first space is excluded from at least said second space and air conducted and discharged from said second space is excluded at least from said first space;

said first and said second separate air providing means each having separate ducting, wherein said ducting of each of said separate air providing means comprises at least one substantially vertical air shaft which extends through all said vertically-spaced decks for ventilation of deck spaces thereinbetween;

each said at least one shaft having substantially adjacent, substantially vertical ducts for incoming air, circulating air and exhaust air, and also each said substantially vertical duct having its corresponding horizontal duct connected thereto for incoming air, circulating air and exhaust air respectively, said horizontal ducts branching off solely from corresponding ones of said vertical ducts, of their corresponding separate air providing means, into individual ones of said deck spaces;

each of said first and said second air providing means having its own separate air conditioner unit for air conditioning at least said circulating air and means for connecting each said air conditioning unit to its corresponding air ducts.

2. The ship according to claim 1, wherein said first air providing means is wholly disposed in said first space and wherein said second air providing means is wholly disposed in said second space.

3. The ship according to claim 1, wherein said ship has a forward portion and wherein, in said forward portion, several of tbe spaces are combined into a common, separate ventilation area.

4. The ship according to claim 1, including a plurality of separate air providing means each having separate ducting, each of said plurality of air providing means having its air conditioning unit disposed in its separate container; and each said container having each standardized and substantially uniform corresponding dimensions compared to at least one other corresponding container for holding air providing means.

5. The ship according to claim 1, including a plurality of air providing means and wherein at least one of said plurality of air providing means has its air conditioning unit disposed in an upper portion of its corresponding space between its corresponding bulkheads.

6. The ship according to claim 1, including a plurality of air providing means and wherein said ship has superstructure and wherein at least some of said air providing means are disposed in said superstructure.

7. The ship according to claim 6, wherein at least one of said plurality of air providing means has air conditioning units, and wherein said air conditioning units of at least some of said air providing means are disposed at least partially between two adjacent bulkheads defining one separate space therebetween.

8. The ship according to claim 5, wherein said air conditioning unit is disposed fore and aft of said one separate space for which these components provide air;

said ship having bulkheads disposed from one another at a bulkhead interval distance, each pair of bulkheads defining a separate space therebetween; and said air conditioning unit not being disposed more than one bulkhead interval distance beyond the bulkheads defining the space between the bulkheads of its corresponding one separate space, being fed by said air conditioning unit.

9. The ship according to claim 4, wherein all of said containers have substantially equivalent corresponding dimensions.

10. The ship according to claim 1, including a superstructure which has additional, horizontal, separate ventilation regions disposed therein;

said separate ventilation regions being solely disposed to ventilate said superstructure and being disposed such as not to ventilate said separate spaces within said hull; and said separate ventilation regions in said superstructure having their own incoming and outgoing air ducts which are separate from said separate spaces in said hull.

11. The ship according to claim 10, wherein said separate ventilation regions extend horizontally over at least two of said bulkheads.

12. The ship according to claim 1, wherein said air conducting and removing means are located on one of said bulkheads of its corresponding separate space.

13. The ship according to claim 1, wherein said vertical ducts of one air providing means are disposed in the proximity of a bulkhead.

14. The ship according to claim 9, wherein said containers are standardized and each said standardized container is disposed near a vertical air shaft.

15. The ship according to claim 14, wherein each said standardized container is disposed in said transverse direction of said hull and substantially in a middle portion of its corresponding separate space for ventilation thereof.

16. The ship according to claim 4, including at least one outside air intake tube wherein said ship has a superstructure with side walls and wherein said at least one outside air intake tube leads into its standardized container through said side wall of said superstructure.

17. The ship according to claim 4, wherein each standardized container includes atomic, biological and chemical filter set means, an air inlet which feeds said filter set, and said air conditioning units connected to said filter set.

18. The ship according to claim 17, wherein said air conditioning unit has a circulation ventilator, an air heater, an air cooler and an air treatment apparatus.

19. The ship according to claim 14, wherein each standardized container has an exhaust air blower.

20. The ship according to claim 4, wherein each standardized container has associated shock absorbers and wherein each standardized container is mounted in said ship by means of said shock absorbers.

21. The ship according to claim 4, wherein said ship has ventilator rooms and wherein each said container is installed in a ventilator room, each said container being closed on all sides and equipped with an acoustical lining, and each said container has a circulation duct and a circulation intake opening inside said ventilator space.

* * * * *